US005249795A

United States Patent [19]

Nishimoto

[11] Patent Number: 5,249,795

[45] Date of Patent: Oct. 5, 1993

[54] SHEET FEEDING APPARATUS

[75] Inventor: Yoshifumi Nishimoto, Yokohama, Japan

[73] Assignee: Canon Kabushiki Kaisha, Tokyo, Japan

[21] Appl. No.: 989,948

[22] Filed: Dec. 10, 1992

Related U.S. Application Data

[63] Continuation of Ser. No. 759,902, Mar. 6, 1991, abandoned.

[30] Foreign Application Priority Data

Mar. 7, 1990 [JP] Japan ..... 2-56013

[51] Int. Cl.[5] ..... B65H 7/02

[52] U.S. Cl. ..... 271/265; 271/267

[58] Field of Search ..... 271/264, 265, 267, 270, 271/272-274, 306, 176, 193

[56] References Cited

U.S. PATENT DOCUMENTS

| | | | |
|---|---|---|---|
| 4,723,129 | 2/1988 | Endo et al. . | |
| 4,740,796 | 4/1988 | Endo et al. . | |
| 4,753,433 | 6/1988 | Rodi et al. | 271/265 X |
| 4,997,177 | 3/1991 | Mori et al. | 271/267 |
| 5,071,113 | 12/1991 | Nakamura et al. | 271/267 |
| 5,085,423 | 2/1992 | Nishimoto et al. | 271/267 X |

FOREIGN PATENT DOCUMENTS 59-177243 10/1984 Japan .

*Primary Examiner*—David H. Bollinger

*Attorney, Agent, or Firm*—Fitzpatrick, Cella Harper & Scinto

[57] ABSTRACT

The present invention provides a sheet feeding apparatus comprising a feeding device for feeding a sheet, in which the sheet (member to be fed) is urged against surfaces of elastic members that are opposed to surfaces on which vibration elements are fixedly mounted, and a frequency voltage is applied to the vibration elements to create vibration waves in the elastic members, whereby a feeding force is supplied to the sheet by vibrating surfaces of the elastic members on which the vibration waves are created. A detecting device is also provided for detecting a feeding amount of the sheet. The apparatus is adapted to urge and pinch the sheet by a rotary shaft of a rotation angle detection device or a roller fixed to the rotary shaft and a rotatable pressure roller disposed in confronting relation to the aforementioned roller. The pressure roller of the sheet feeding amount detecting device or the rotation angle detection device is attached to a pressurizing device which can vary an urging force acting on the sheet.

26 Claims, 2 Drawing Sheets

SHEET FEEDING APPARATUS

This application is a continuation of application Ser. No. 07/759,902 filed Mar. 6, 1991, abandoned.

BACKGROUND OF THE INVENTION

1. Field of the Invention

The present invention relates to a sheet feeding apparatus incorporated into various types of equipment having a mechanism for feeding a sheet, such as a computer, copying machine, facsimile, word processor, typewriter and the like.

2. Related Background Art

In the past, as disclosed in the Japanese Patent Laid-Open No. 59-177243, such a sheet feeding apparatus was so designed that travelling waves were applied to elastic members pinching a sheet therebetween, thus feeding the sheet.

Now, a sheet feeding principle in this conventional sheet feeding apparatus will be explained with reference to FIG. 2.

A sheet 13 is pinched or interposed between elastic members 5 and 6 with an appropriate pressing force given by the elastic members. Advancing flexural vibrations (travelling waves) are applied to the elastic members 5, 6, respectively. Since it is designed that the phase difference between these flexural vibrations becomes 180° spatially, the flexural vibrations travel or advance in the respective elastic members 5, 6 in such a manner that convex portions created in the respective elastic members and directing toward the interposed sheet 13 always face each other. In this case, in consideration of a certain particle on a surface of the elastic member 5 or 6 (for example, at the convex portion thereof), the particle generally moves along an elliptical orbit. In FIG. 2, regarding the elastic member 5, if the travelling wave advances to the right, the particle will move along the elliptical orbit in a clockwise direction, as shown. Accordingly, the particles on the convex portions of the elastic members 5, 6 all move in respective directions opposite to the advancing directions of the travelling waves in the elastic members 5, 6, respectively, thereby providing a force for feeding the sheet 13.

On the other hand, although a sheet feeding force created at concave portions of the elastic members acts in the same direction as the advancing direction of the travelling wave, since the pressing forces of the concave portions against the sheet are smaller than those of the convex portions, the friction forces between the elastic members 5, 6 and the sheet at the concave portions are also smaller, and, thus, the sheet feeding force created by the concave portions will be smaller than that created by the convex portions. Accordingly, the total sheet feeding force acts in the direction opposite to the advancing direction of the travelling wave.

FIGS. 3 and 4 depict sheet feeding apparatuses using such sheet feeding principle, where FIG. 3 shows an example that a pair of rollers are disposed at a sheet introducing side and FIG. 4 shows an example that the pair of rollers are disposed at a sheet ejecting side. In FIGS. 3 and 4, the reference numerals 1, 2, 3, 4 denote vibration elements each comprising a piezo-electric element acting as an electro-mechanical energy transducer (energy conversion element); 5, 6 denote the above-mentioned elastic members; 7 denotes an oscillator; 10 denotes an energy absorber; and CNT denotes a controller.

The vibration elements 1, 2 are fixedly mounted on the elastic member 5 by an adhesive and the like to constitute one set of vibrators. Similarly, the vibration elements 3, 4 are fixedly mounted on the elastic element 6 to constitute the other set of vibrators. Further, the elastic members 5 and 6 are urged against each other with an appropriate force, for example, by means of springs. In the illustrated embodiment, the elastic elements 5, 6 are made of conductive material and are connected to an earthing circuit or ground. By applying a frequency voltage (alternate electric field) to the vibration element 1 by means of the oscillator 7, the elastic members 5, 6 are vibrated. The vibration elements 2, 4 generate electric energy due to the vibration of the elastic elements 5, 6. The generated electric energy is dispersed by the energy absorber 10 including resistors and the like. Accordingly, the vibration of the elastic members is not reflected, but creates travelling waves in the elastic members. When the flexural vibration of each elastic member 5, 6 creates the travelling wave, a certain particle on the surface of the elastic member moves along an elliptical orbit. Accordingly, the outer portion of the flexural vibration always has a component of velocity directing toward a direction opposite to an advancing direction of the travelling wave. Since the sheet 13 always contacts with the outer portion of the flexural vibration, it is fed to the direction opposite to the advancing direction of the travelling wave. In this way, in FIGS. 3 and 4, the sheet is fed from right to left.

The reference numeral 8 denotes a rotary encoder; 11 denotes a roller fixed to a rotary shaft of the rotary encoder; and 9 denotes a roller. The roller 9 serves to urge the cut sheet 13 against the roller 11 to prevent the slip between the roller 11 and the sheet 13. As the cut sheet 13 is shifted, pulse signals are sent from the encoder 8 to the controller CNT. The controller CNT comprises a microcomputer and is designed to count the number of pulse signals from the encoder 8 for controlling the driving of the oscillator 7. Since it is so designed that the number of pulse signals of the encoder corresponding to a predetermined shifting amount of the sheet is previously set in the controller on the basis of an outer diameter of the roller 11 of the encoder 8 and the number of pulses per a revolution of the encoder, the controller can stop or deenergize the oscillator 7 when it receives a predetermined number of pulses. When the oscillator 7 is deenergized, the travelling waves are stopped, thus storing the sheet feeding force. Since the elastic members 5, 6 are urged against the sheet 13 with the appropriate force, when the travelling waves are stopped, a great friction force is generated between the elastic members and the sheet, thereby braking the sheet 13 which tends to still move by its own inertia. As mentioned above, since the braking force is great, the sheet can be stopped for a very short time substantially without overrun, and, therefore, the sheet can be positioned with high accuracy.

Further, a pinching force of the rollers 9, 11 for pinching the sheet therebetween was selected to be sufficiently great to prevent the slip between the roller 11 and the sheet 13 and to be substantially constant.

However, as mentioned above, since the relatively great and constant pinching force was applied between two rollers 9, 11 for detecting the feeding amount of the sheet 13 to prevent the occurrence of the slip between the roller and the sheet, there arose a problem that the sheet was difficult to be inserted between the rollers 9, 11 due to the reaction force from these rollers.

SUMMARY OF THE INVENTION

An object of the present invention is to provide a sheet feeding apparatus which can smoothly insert a sheet between rollers for detecting a feeding amount of the sheet and in which the sheet can be pinched between the rollers without slip.

According to one aspect of the present invention, there is provided a sheet feeding apparatus comprising a feeding means for feeding a sheet, in which the sheet (member to be fed) is urged against surfaces of elastic members that are opposed to surfaces on which vibration elements are fixedly mounted, and a frequency voltage is applied to the vibration elements to create vibration waves in the elastic members, whereby a feeding force is supplied to the sheet by vibrating surfaces of the elastic members on which the vibration waves are created; and a detecting means for detecting a feeding amount of the sheet and adapted to urge and pinch the sheet by a rotary shaft of a rotation angle detection means or a roller fixed to the rotary shaft and a rotatable pressure roller disposed in confronting relation to the aforementioned roller; wherein the pressure roller of the sheet feeding amount detecting means or the rotation angle detection means is attached to a pressurizing means which can vary an urging force acting on the sheet.

Other objects of the present invention will be apparent from the following explanation.

BRIEF DESCRIPTION OF THE DRAWINGS

FIG. 1A is a schematic constructural view of a main part of the apparatus and FIG. 1B is a flow chart for explaining an operation of the apparatus;

DESCRIPTION OF THE PREFERRED EMBODIMENTS

Figure 3:
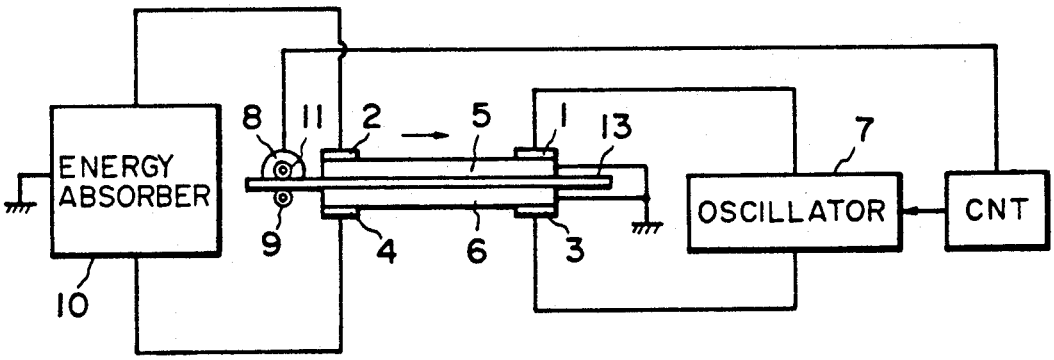
FIG. 3 PRIOR ART
FIGS. 3 and 4 are schematic constructional views of conventional sheet feeding apparatuses.
Figure 4:
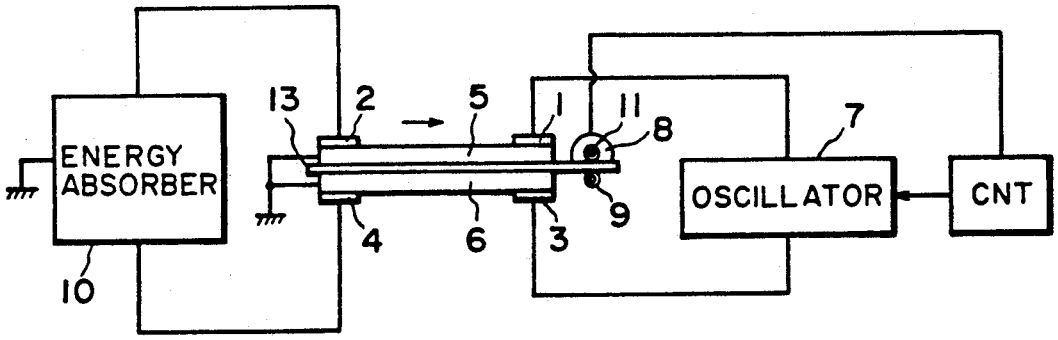
FIG. 4 PRIOR ART

The present invention will now be explained in connection with embodiments thereof with reference to the accompanying drawings. Incidentally, elements similar as those of the conventional apparatuses shown in FIGS. 3 and 4 are designated by the same reference numerals and the explanation thereof will be omitted.

Figure 1A:
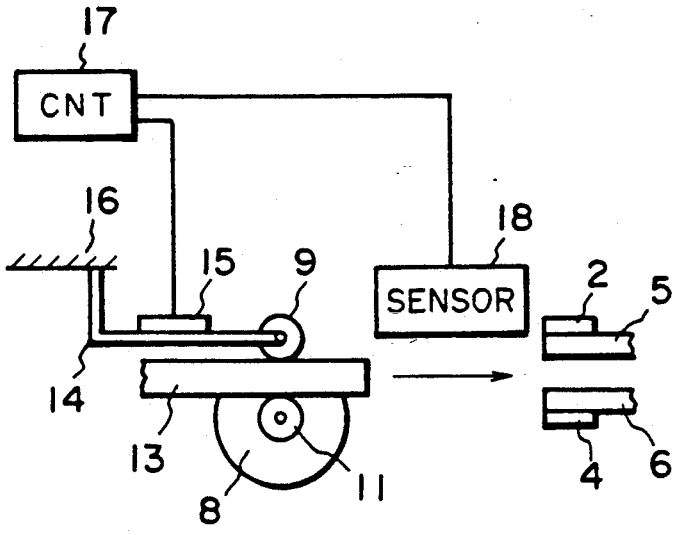
FIGS. 1A and 1B show sheet feeding apparatuses according to a preferred embodiment of the present invention, where

FIG. 1A schematically shows a main part of a bubble jet printer incorporating a sheet feeding apparatus according to the present invention. Incidentally, the bubble jet printer is a printer, for example, as disclosed in U.S. Pat. Nos. 4,723,129 and 4,740,796. Briefly speaking, in the bubble jet printer, in response to recording information, by applying at least one drive signal to an electro-thermal transducer disposed in a liquid path containing liquid (ink) therein to abruptly heat the liquid exceeding the nucleate boiling temperature, thermal energy is generated in the electro-thermal transducer, thus creating thin film boiling at a heat acting portion of a recording head, whereby a bubble is formed in the liquid (ink). The liquid (ink) is discharged from a discharge opening of the recording head due to the growth and shrinkage of the bubble to form at least one liquid droplet. By ejecting the droplet toward sheet, an image is formed on the sheet.

The sheet feeding apparatus according to this embodiment is characterized in that, by varying an urging force of rollers (rotary members) 9, 11 acting on a cut sheet 13, when the sheet is inserted between the rollers 9 and 11 from an introduction side or an ejecting side, a reaction force from the rollers 9, 11 (acting on the sheet) becomes smaller.

In FIG. 1, the sheet 13 is urgingly pinched between the roller 11 fixed to a rotary shaft of a rotary encoder 8 and the roller 11 disposed in confronting relation to the roller 9, so that the roller 11 is rotated due to a friction force between the sheet 13 and the roller 11 as the sheet 13 is shifted. The rotation of the roller 11 is detected by the rotary encoder 8, thus determining a shifting amount or speed of the sheet 13.

Further, in order to prevent the slip between the sheet 13 and rollers 9, 11, since it is necessary to pinch the sheet between the rollers with the moderate urging force, the roller 9 is urged against the sheet 13 by means of a leaf spring 14, one end of which is attached to a frame 16 of the printer. As mentioned above regarding the conventional examples, when the sheet 13 is inserted between the rollers 9, 11, the reaction force from the rollers acts on the sheet 13, thus potentially giving rise to the problem that the sheet cannot be fed smoothly.

In order to solve this problem, according to the illustrated embodiment, a piezo-electric element 15 acting as an urging force adjusting member is fixedly mounted on the spring 14.

The energization of piezo-electric element 15 is controlled by a controller 17 (for example, comprising a microcomputer).

The piezo-electric element 15 can deform to shrink or contract in an up-and-down direction (FIG. 1) as the voltage applied to this element is increased. Accordingly, when the voltage applied to the piezo-electric transducer is increased, the leaf spring 14 is flexed in a direction such that the roller 9 is moved upwardly, with the result that the urging force between the rollers 9, 11 is decreased. A photo-sensor 18 forming a sensor element of a photo-coupler is disposed forwardly of the rollers 9, 11 (i.e., the sheet ejecting side) and serves to detect the presence of the sheet 13 passing through between the rollers 9, 11. A detection signal from the photo-sensor 18 is sent to the controller 17 to control the energization of the piezo-electric element 15.

Figure 1B:
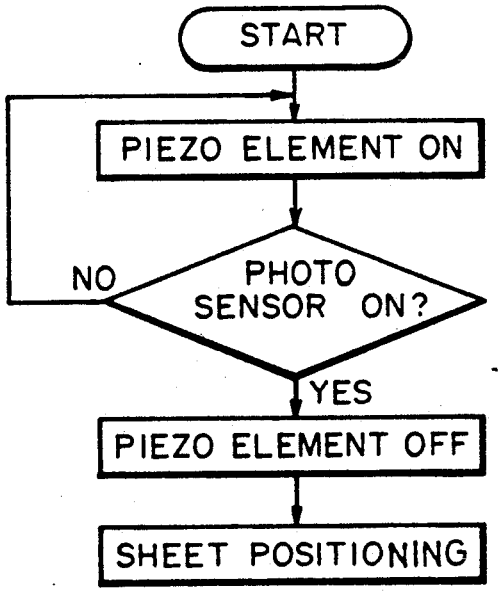
Figure 2:
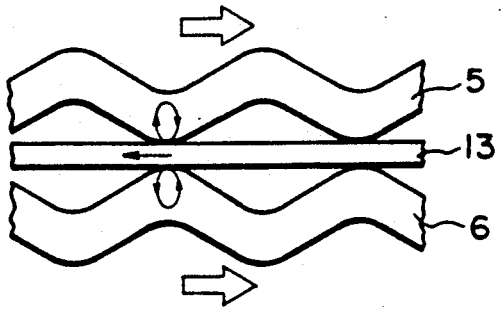
FIG. 2 PRIOR ART
FIG. 2 is an explanatory view for explaining a sheet feeding principle.

Next, an operation of the controller 17 effected when the cut sheet 13 is introduced into the apparatus will be explained with reference to a flow chart shown in FIG. 1B.

Before the sheet 13 is inserted between the rollers 9, 11 (refer to FIG. 1A), a voltage is applied to the piezo-electric element 15 from the controller 17 via a supply line (not numbered) so that the urging force of the rollers becomes small. Consequently, the sheet 13 can be smoothly inserted between the rollers without undergoing much of a reaction force from the roller 9. When a leading end of the sheet 13 is detected by the photo-sensor 18, the voltage (to the piezo-electric element) is reduced or stopped, thus increasing the urging force of the roller 9 against the sheet 13, with the result that the slip between the sheet 13 and the rollers 9, 11 is suppressed or eliminated. Thereafter, the sheet feeding and positioning operation is performed in the same manner as the conventional example described above.

The present invention is not limited to the illustrated embodiment. For example, the rotary encoder may be of shiftable type.

Further, the urging force of the rollers may be increased as the voltage is increased.

In addition, the present invention is applicable to a sheet feeding apparatus wherein the rollers 9, 11 are disposed at the sheet ejecting side as shown in FIG. 4.

Furthermore, the elastic members for applying the feeding force to the sheet may each comprise an elliptical annular running track.

As mentioned above, according to the present invention, it is possible to reduce the urging force between the rollers when the sheet is inserted into the sheet feeding amount detecting means, thus permitting the smooth feeding of the sheet, thereby preventing skewed feeding of the sheet and the like.

I claim:

1. A sheet feeding control device adapted to be used with a printer, for feeding a sheet by a vibration wave, said device comprising:

(a) detecting means for contacting the sheet and for detecting a feeding state of the sheet; and (b) adjusting means for adjusting a contacting force between the sheet and said detecting means;

said adjusting means being adapted to adjust the contacting force between a first level before the sheet if contacted with said detecting means in a second level after the sheet has been contacted with said detecting means, the second level of the contacting force being greater than the first level.

2. A control device according to claim 1, wherein said detecting means includes a driven member rotatingly driven in accordance with the feeding of the sheet, the driven member generating a signal corresponding to a shifting amount or speed of the sheet.

3. A control device according to claim 2, wherein said adjusting means includes a rotary member for contacting the sheet, said rotary member being disposed in confronting relation to said driven member in order to pinch the sheet; a detecting member for generating a control signal after the sheet has contacted said detecting means; and an electro-mechanical energy conversion element for engaging said rotary member and being responsive to said control signal, to vary a contacting force between said rotary member and the sheet.

4. A control device according to claim 3, wherein said detecting member includes a photo-sensor for detecting a position of the sheet.

5. A control device according to claim 3, wherein said electro-mechanical energy conversion element comprises a piezo-electric element.

6. A control device according to claim 5, wherein said piezo-electric element is attached to a spring having one end fixed and the other end engaged by said rotary member, said piezo-electric element being adapted to distort said spring in response to said control signal.

7. A control device according to claim 6, wherein said spring comprises a leaf spring.

8. A control device according to claim 1, wherein said printer is a bubble jet printer.

9. A sheet feeding apparatus for an office equipment, said apparatus comprising:

(a) a vibration member provided in contact with a sheet for generating a travelling vibration wave to feed the sheet in response to an applied periodic signal;

(b) a detecting member having a rotatable element which contacts the sheet for generating a signal corresponding to a feeding state of the sheet, wherein said rotatable element is rotated by the sheet when the sheet is fed in a predetermined direction; and (c) urging force control means for controlling a force for urging the sheet against said rotatable element, said urging force control means including an element for generating a control signal after the sheet has contacted said rotatable element, an urging element for generating the urging force, and a control circuit for increasing the urging force of said urging element in response to the control signal.

10. A sheet feeding apparatus according to claim 9, wherein said office equipment comprises a printer.

11. An apparatus for conveying a sheet, said apparatus comprising:

(a) a vibration member for contacting the sheet and for generating a vibration wave to convey the sheet;

(b) a rotating member for contacting the sheet to apply a press-contacting force to the sheet, said rotating member being rotatable in accordance with movement of the sheet;

(c) a sensor for detecting a position of the sheet and for generating a control signal in response to contact of the sheet to said rotating member;

(d) a press-contacting force adjusting member coupled to said rotating member, said adjusting member for changing, in response to the control signal, the press-contacting force of said rotating member to the sheet between a first force and a second force which is greater than the first force; and (e) a detection member coupled to said rotating member for detecting an amount of movement of the sheet.

12. An apparatus according to claim 11, wherein said rotating member comprises first and second rollers arranged so as to pinch the sheet and said press-contacting force adjusting member comprises an electro-mechanical energy conversion element coupled to said first roller so as to move said first roller in a direction toward the sheet and a direction away from the sheet.

13. An apparatus according to claim 12, wherein said sensor comprises a photo-sensor for detecting the position of the sheet.

14. An apparatus according to claim 12, wherein said press-contacting force adjusting member includes a spring, one end of said spring being fixed at a predetermined location and the other end being engaged with said first roller and a piezoelectric element mounted on said spring for pivotally displacing said spring in response to the control signal from said sensor.

15. An apparatus according to claim 14, wherein said spring comprises a leaf spring.

16. An apparatus according to claim 12, wherein said detection member comprises a rotary encoder engaged with said second roller which is rotated by movement of the sheet.

17. An apparatus for conveying a sheet, said apparatus comprising:

(a) a vibration member for contacting the sheet and for generating a vibration to convey the sheet;

(b) a rotating member for contacting the sheet and for applying a press-contacting force to the sheet and being rotated by a movement of the sheet;

(c) a sensor for detecting a position of the sheet and for generating a control signal when the sheet reaches a predetermined position relative to said rotating member;

(d) a press-contacting force adjusting member engaged with said rotating member for changing, in response to the control signal, the press-contacting force of said rotating member to the sheet between a first press-contacting force and a second press-contacting force which is greater than the first press-contacting force; and (e) a detection member coupled to said rotating member for detecting movement of the sheet.

18. An apparatus according to claim 17, wherein said rotating member comprises first and second rollers arranged so as to pinch the sheet and said press-contacting force adjusting member comprises an electro-mechanical energy conversion element coupled to said first roller so as to move said first roller in a direction toward the sheet and a direction away from the sheet.

19. An apparatus according to claim 18, wherein said sensor comprises a photo-sensor for detecting the position of the sheet.

20. An apparatus according to claim 18, wherein said press-contacting force adjusting member includes a spring, one end of the spring being fixed at a predetermined location and the other end being engaged with said first roller and a piezoelectric element mounted on said spring for pivotally displacing said spring in response to the control signal from said sensor.

21. An apparatus according to claim 20, wherein said spring comprises a leaf spring.

22. An apparatus according to claim 20, wherein said detection member comprises a rotary encoder engaged with said second roller which is rotated by movement of the sheet.

23. An apparatus according to claim 17, wherein said vibration member forms an insertion slot and a discharge slot for the sheet.

24. An apparatus according to claim 23, wherein said rotation member is located at a discharge slot side of said vibration member.

25. An apparatus for conveying a sheet, said apparatus comprising:

a vibration member for contacting the sheet and for generating a vibration to convey the sheet;

a rotating member for contacting the sheet, applying a press-contacting force to the sheet and being rotated by the sheet;

a press-contacting force adjusting member engaged with said rotating member for changing, when the sheet reaches a predetermined position relative to said rotating member, the press-contacting force of said rotating member to the sheet from a first press-contacting force level to a second press-contacting force level which is stronger than the first press-contacting force level; and a detection member coupled to said rotating member for detecting movement of the sheet.

26. An apparatus according to claim 25, wherein said detecting member includes an encoder actuated by rotation of said rotating member.

* * * * *

UNITED STATES PATENT AND TRADEMARK OFFICE

CERTIFICATE OF CORRECTION

PATENT NO. : 5,249,795

DATED : October 5, 1993

INVENTOR(S) : Yoshifumi NISHIMOTO

It is certified that error appears in the above-indentified patent and that said Letters Patent is hereby corrected as shown below:

On title page,

AT *Attorney, Agent, or Firm*:

"Fitzpatrick, Cella Harper & Scinto" should read --Fitzpatrick, Cella, Harper & Scinto--.

COLUMN 5:

Line 25, "if" should read --is--, and "in" should read --and--.

Signed and Sealed this

Sixth Day of September, 1994

*Attest:*

*Attesting Officer*

BRUCE LEHMAN

*Commissioner of Patents and Trademarks*